US007409921B1

(12) United States Patent
Jones

(10) Patent No.: US 7,409,921 B1
(45) Date of Patent: Aug. 12, 2008

(54) SEA PERCH PLATFORM SEAT GUARDRAIL APPARATUS

(75) Inventor: Clinton Jones, Cape Town (ZA)

(73) Assignee: Robertson & Gaine (Pty) Ltd., Cape Town (ZA)

( * ) Notice: Subject to any disclaimer, the term of this patent is extended or adjusted under 35 U.S.C. 154(b) by 0 days.

(21) Appl. No.: 11/756,652

(22) Filed: Jun. 1, 2007

(51) Int. Cl.
*B63B 17/00* (2006.01)
*E04G 1/00* (2006.01)

(52) U.S. Cl. ..... 114/362; 114/363; 182/20

(58) Field of Classification Search ..... 114/362
See application file for complete search history.

(56) References Cited

U.S. PATENT DOCUMENTS 3,570,029 A * 3/1971 Hunsaker ..... 114/362
5,537,949 A * 7/1996 Blevins et al. ..... 114/362
5,628,274 A * 5/1997 Biedenweg et al. ..... 114/362
5,915,328 A * 6/1999 Rowan ..... 114/362
7,004,101 B1 * 2/2006 Mardikian ..... 114/362

* cited by examiner

*Primary Examiner*—Jesús D Sotelo
(74) *Attorney, Agent, or Firm*—Dennis G. LaPointe

(57) ABSTRACT

A sea perch apparatus includes a platform configured to be located between a pair of spaced-apart sea perch support members located along a side or end of a boat. The platform is designed to be elevated so as to be in an upright position between the sea perch support members and lowered so as to be in a horizontal lower position near a waterline in which the boat is flowing when in the water. The platform serves as a guardrail between the sea perch support members, and when the platform is in the lower position, it serves as a swimming dock, tanning deck and further serves to facilitate easier embarking and disembarking to and from another boat. The platform is transformable into a seat when upright with arm rest. When upright, it is locked in place on either side of the upper side of the platform.

15 Claims, 7 Drawing Sheets

SEA PERCH PLATFORM SEAT GUARDRAIL APPARATUS

FIELD OF THE INVENTION

The invention relates to a sea perch for use between davits, superstructure portions, pulpits or stanchions at the stern or other portions of a boat.

BACKGROUND OF THE INVENTION

There are often safety issues that arise when boaters try to disembark a dinghy and step onto the deck of a boat and vice-versa. Similarly, swimmers at an anchored boat can have difficulty getting up to the deck without additional assistance from ladders. In addition, some stern decks with davits, superstructure portions, pulpits or stanchions also do not have safety or guardrails at the stern so a boater can, with a rapid acceleration of the engines, fall overboard behind the boat.

What is needed is a sea perch that is designed to accommodate and resolve each of the above described issues or shortcomings.

SUMMARY OF THE INVENTION

Generally, the invention is a sea perch apparatus. It includes a platform configured to be generally located between a pair of spaced-apart davits, superstructure portions, pulpits, stanchions, or conveniently located combinations thereof at a stern of a boat or at other portions of the boat such as the starboard or port sides, bow end of a boat, or at a main deck level or upper level deck for larger multi-deck boats, where it is convenient to install the invention. This pair of spaced-apart davits, superstructure portions, pulpits, stanchions, or conveniently located combinations thereof will be referred to herein collectively as sea perch support members.

The platform can be selectively elevated so as to be in a generally upright position between the sea perch support members and lowered so as to be in a generally horizontal lower position at a predetermined height above a waterline in which the boat is floating when in the water.

When the platform is in the upright position, it serves as a guardrail between the sea perch support members. When the platform is in the lower position, it serves as a swimming dock or a tanning deck and further serves to facilitate easier embarking and disembarking to and from another boat, such as a dinghy.

The platform is transformable into a seat when in the upright position. A bottom portion is raised in a generally horizontal orientation to support one or more persons desiring to sit on the seat, and an upper portion forms a back rest for the seat. An elevated arm rest on one side of the bottom portion or on both sides can be incorporated with the platform seat portion. When the platform is lower near the waterline, the arm rest(s) can be used as a step to further facilitate embarking onto the boat.

The bottom portion can be maintained in the generally horizontal position by using a rope, lanyard, strop or other tie line connected to an eye or other similar structure at or near each frontal corner of the bottom portion with an opposite end of the tie line connected to the sea perch support members or to an upper edge of the upper portion (back rest) of the platform. Typically, the bottom portion is hingedly connected to the upper portion.

The platform can be elevated or lowered using a winch connected to one of the sea perch support members. The winch cable, line or strop is attached near the upper corners of the platform. The platform has a frame structure that pivotally connects to a desired accessible portion of the boat or the sea perch support members themselves. For example, the platform can be supported between two J-shaped frame members where the end of the curved portion of the frame is pivotally attached to a portion of the sea perch support member near where the sea perch support member attaches to the boat.

The invention further comprises means for selectively locking and unlocking an upper portion of the platform to each of the spaced-apart sea perch support members when the platform is in the upright position. One example of providing this feature is to have a cross-frame member near the upper edge of the platform such as a tube running between the J-shaped frame members. When in the upright position, the cross-frame member can be snapped into a spring loaded C-clamp receiver, which can be mechanized with an operatively connected lever wherein the spring loaded C-clamp receiver is configured to lock the cross-frame member in place or to unlock and release the cross-frame member when the platform is to be lowered. Other means known in the art for locking and unlocking the platform in the upright position can be used, such as pins through the sea perch support members into a receiver aperture in the platform sides (or vice-versa); however, that described more specifically herein and in the drawings is merely an example of a preferred safety latching device.

Operation of the Multi-Purpose Sea Perch

The multi-purpose sea perch has four main functions:

In its "up" position it acts as a guardrail between the sea perch support members enhancing safety in the aft area of the cockpit.

In its "up" position it also can provide extra seating in the aft area of the cockpit.

In its "down" position it can be used as easier access swimming, diving, and dinghy docking.

In its "down" position it also provides extra deck area for relaxing, tanning, etc.

Guardrail

When in the "up" position, two safety latches hold the platform securely between the sea perch support members forming a protected area aft of the cockpit. The safety catches can engage automatically but a manual safety system is optional where in the unlocked position, two levers protrude into the walk area. The levers are made longer than necessary to ensure they are in the way when not latched correctly. It is preferred that the levers also have colored knobs (such as red) to add visual awareness. When latched down they are spring loaded to positively latch them. In this position people can lean against the guardrail without danger of it unfolding, and it can also be used as a seat safely. The guard rail allows the deck aft of the cockpit to be used safely at sea.

Extra Seating

When in the up position a portion of the platform can be folded up to form a seat. The seat can be held up either by a brace mechanism below the seat or by a tie and hook supporting from above. An armrest at each side of the seat is multipurpose and provides comfort while seated, a handle to ease deployment, and a step when the sea perch is in the "down" position. In an example of a simple model of the invention, the seat is deployed by lifting the seat using the armrest as a handle and hooking the two ties to the eyes provided.

Swimming Dock

The sea perch can be lowered by unlocking the safety latches and lowered using a drum winch attached to the sea perch support member. This winch can double up as a davit winch or be a dedicated sea perch winch. A spooling-type winch can also be used for a dedicated winch, or winches replaced by a block and tackle arrangement. Alternatively, the sea perch can be lowered manually assisted by gas-struts, or by fully power-driven struts. Using winches or tackles, the dock is held in its "down" position by ties attached to the sea perch support members. Ties are not necessary when struts are used. When in the down position the dock is in a good position for docking a dinghy, making it easier for passengers to transit from the dinghy to the boat and vice versa. When in this position, the arm rest performs the function of a step, making the climb to the aft cockpit easy. The dock position also provides easy access to the water for scuba diving or snorkeling as all equipment can be easily accommodated alongside the diver. It is also a good swimming and diving platform. Raising is just a reverse of the lowering process and when the platform is fully raised it engages the safety locks mentioned above under the guardrail section.

Tanning Deck

When in its "down" or "dock" position, the sea perch also acts as a tanning deck, increasing the deck area aft of the cockpit to provide extra relaxation space while at anchor. Additional separate seats can be hung from the sea perch support members to provide accommodation for more people in this mode. The seat arm rest forms a step in this position as mentioned above to facilitate access to the deck.

DETAILED DESCRIPTION OF THE INVENTION

Figure 1A:
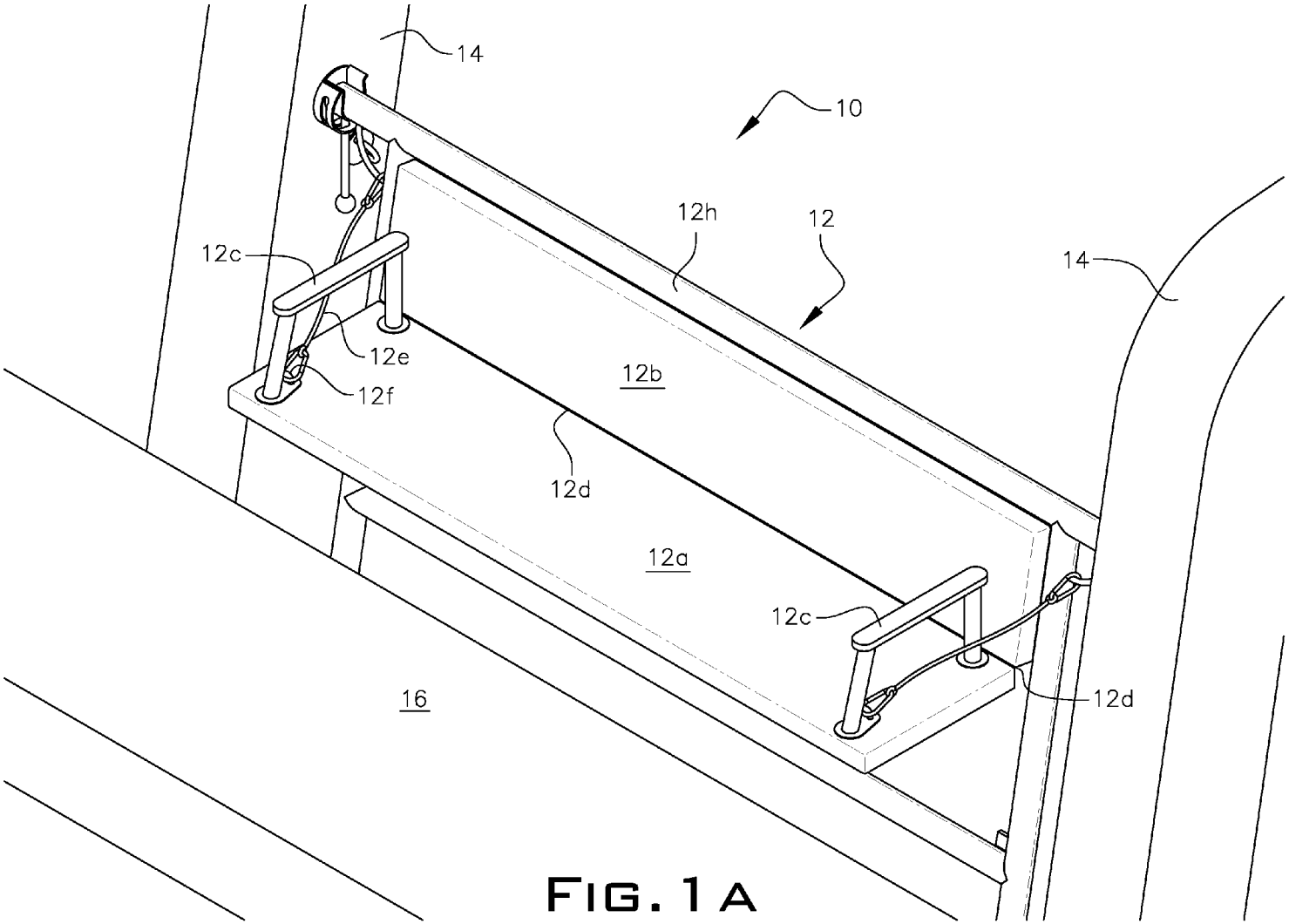
FIG. 1A is a conceptual perspective view of an example of the invention transformed into a seat between the davits at the stern of a boat.
Figure 1B:
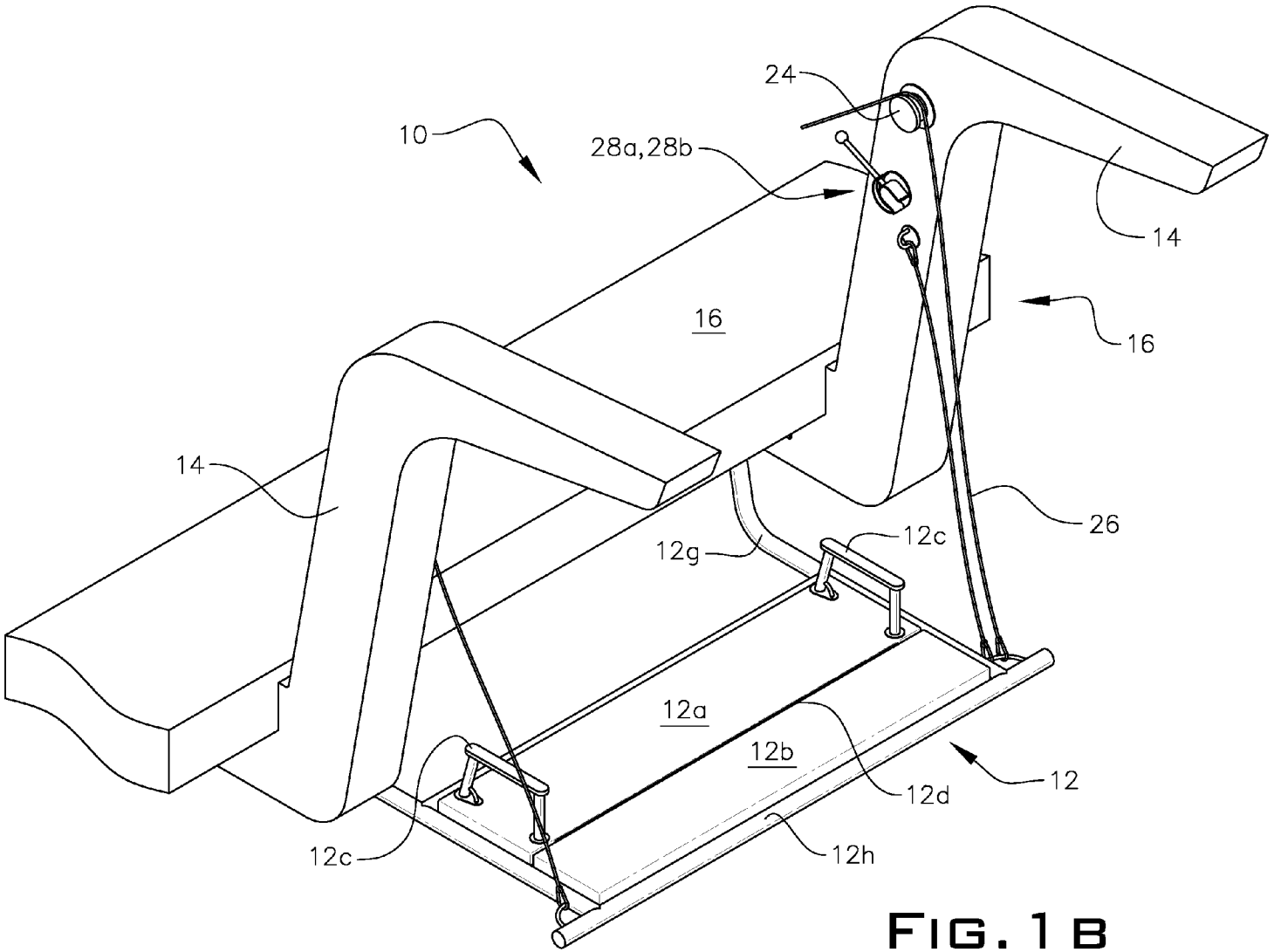
FIG. 1B is a conceptual perspective view of the example depicted in FIG. 1A where the invention is transformed as a platform which has been lowered near the waterline behind the stern of the boat.
Figure 1C:
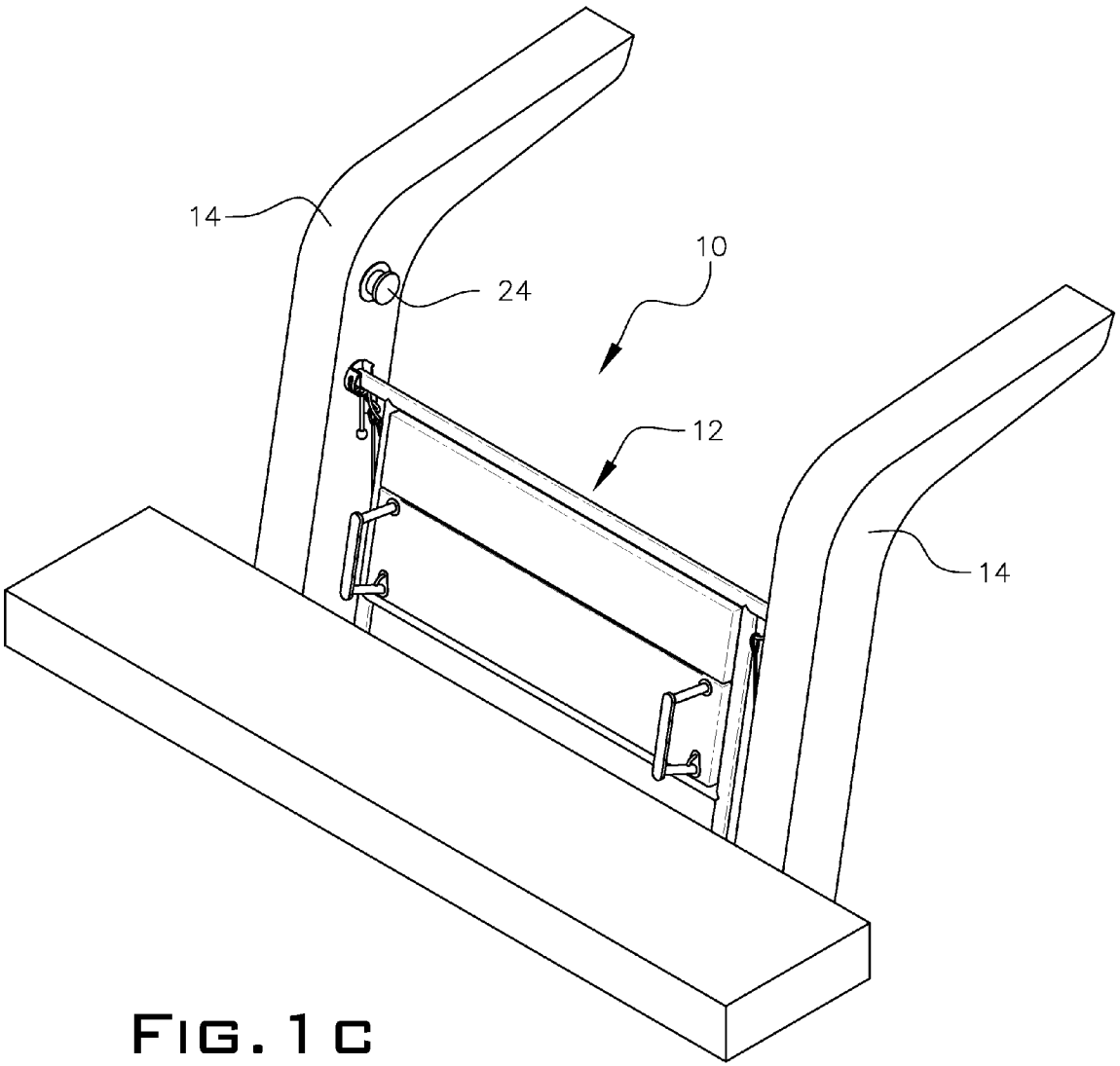
FIG. 1C is a conceptual perspective view of the example of the invention depicted in FIG. 1A where the platform has been elevated and is being used as a rear guardrail between the davits at the stern of a boat.
Figure 1D:
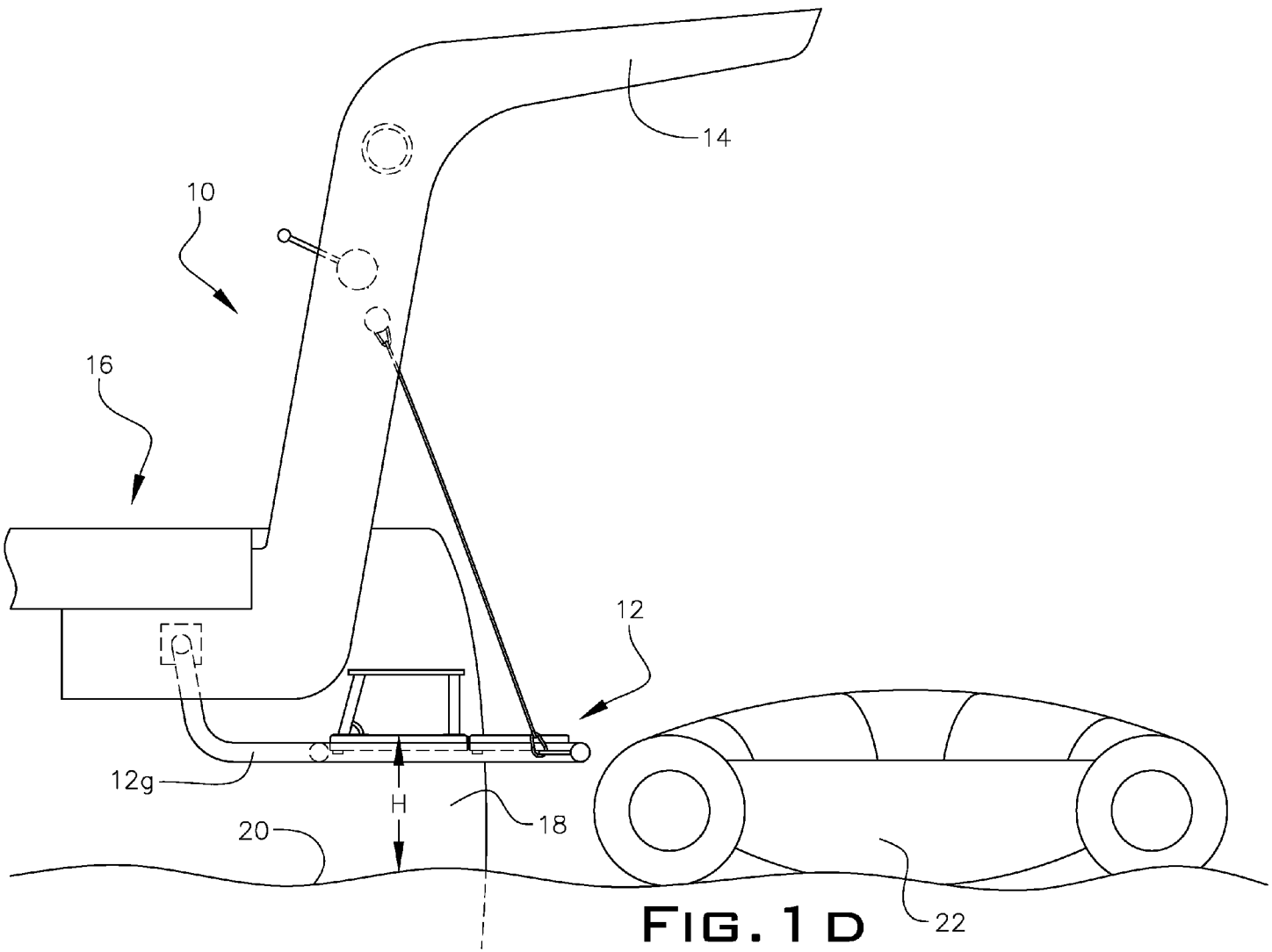
FIG. 1D is a conceptual schematic showing the rotational transformation from a first position, where the inventive platform is used as a rear guardrail, to a second position above the waterline, where the inventive platform can be used as a tanning platform or a dock to embark onto or disembark from another boat like a dinghy.

Referring now to the drawings, FIGS. 1A-1D disclose one embodiment of the present invention, which is a sea perch device or apparatus, depicted generally as 10. The invention is being depicted using davits 14 as an example of sea perch support members. Accordingly, whenever the term davit is used, an equivalent structure can be superstructure portions, pulpits or stanchions and the like. In addition, although the drawings are showing an example of the invention in use at the stern of a boat, the scope of the invention includes the invention located and used at other portions of the boat such as the starboard or port sides, bow end of a boat, or at a main deck level or upper level deck for larger multi-deck boats, where it is convenient to install the invention.

The invention 10 includes a platform 12 configured to be generally located between a pair of spaced-apart davits 14, for example, located at a stern 16, of a boat 18. If the invention 10 was located elsewhere, then stern 16 would be representative of such other portion of the boat 18. The platform 12 can be selectively elevated so as to be in a generally upright position between the davits 14 and lowered so as to be in a generally horizontal lower position at a predetermined height "H" above a waterline 20 in which the boat 18 is floating when in the water.

When the platform 12 is in the upright position, it serves as a guardrail between the davits 14 at the stern 16 of the boat 18. When the platform 12 is in the lower position, it serves as a swimming dock or a tanning deck and further serves to facilitate easier embarking and disembarking to and from another boat 22, such as a dinghy.

The platform 12 is transformable into a seat when in the upright position. A bottom portion 12*a* is raised in a generally horizontal orientation to support one or more persons desiring to sit on the seat, and an upper portion 12*b* forms a back rest for the seat. An elevated arm rest 12*c* on one side of the bottom portion 12*a* or on both sides can be incorporated with the platform 12 seat portion. When the platform 12 is lower near the waterline 20, the arm rest(s) 12*c* can be used as a step to further facilitate embarking onto the stern 16 of the boat 18.

The bottom portion 12*a* can be maintained in the generally horizontal position by using a rope, lanyard, strop or other tie line 12*e* connected to an eye 12*f* or other similar structure at or near each frontal corner of the bottom portion 12*a* with an opposite end of the tie line 12*e* connected to the davits 14 or to an upper edge of the upper portion 12*b* (back rest) of the platform 12. Typically, the bottom portion 12*a* is hingedly attached to the upper portion 12*b*, (see hinge 12*d*).

The platform 12 can be elevated or lowered using a drum winch 24 connected to one of the davits 14. The wince cable, line or strop 26 is attached near the upper corners of the platform 12. The platform 12 has a frame structure 12*g* that pivotally connects to a desired accessible portion of the boat stern 16 area or the davits 14 themselves. For example, the platform 12 can be supported between two J-shaped frame members 12*g* where the end of the curved portion of the frame 12*g* is pivotally attached a portion of the davit 14 near where the davit 14 attaches to the boat stern 16 area.

Figure 2A:
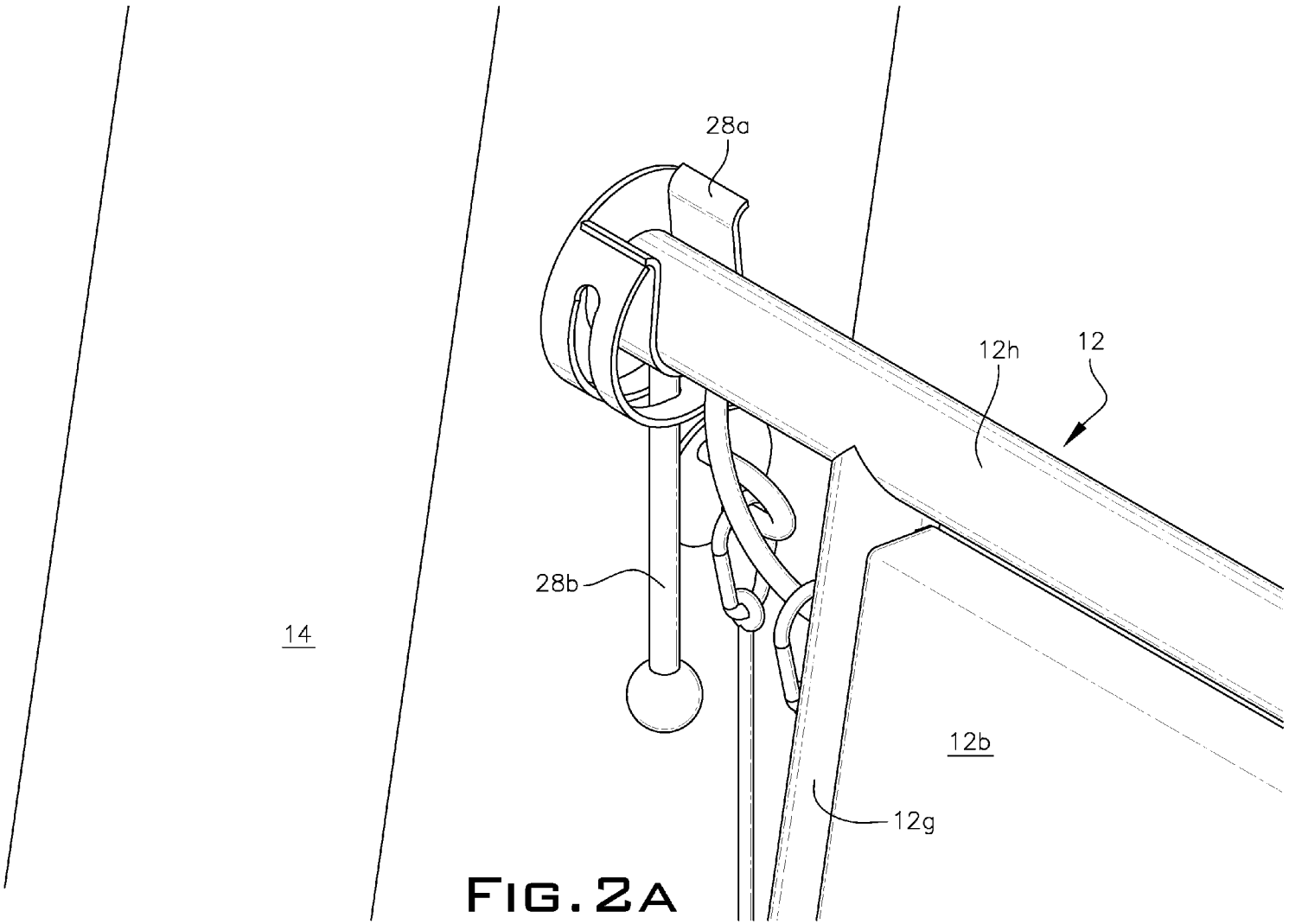
FIG. 2A is a perspective view of one example of providing a latching mechanism for holding/locking the inventive platform in an elevated position, with the lever pointing downward to lock the latching mechanism to the platform.
Figure 2B:
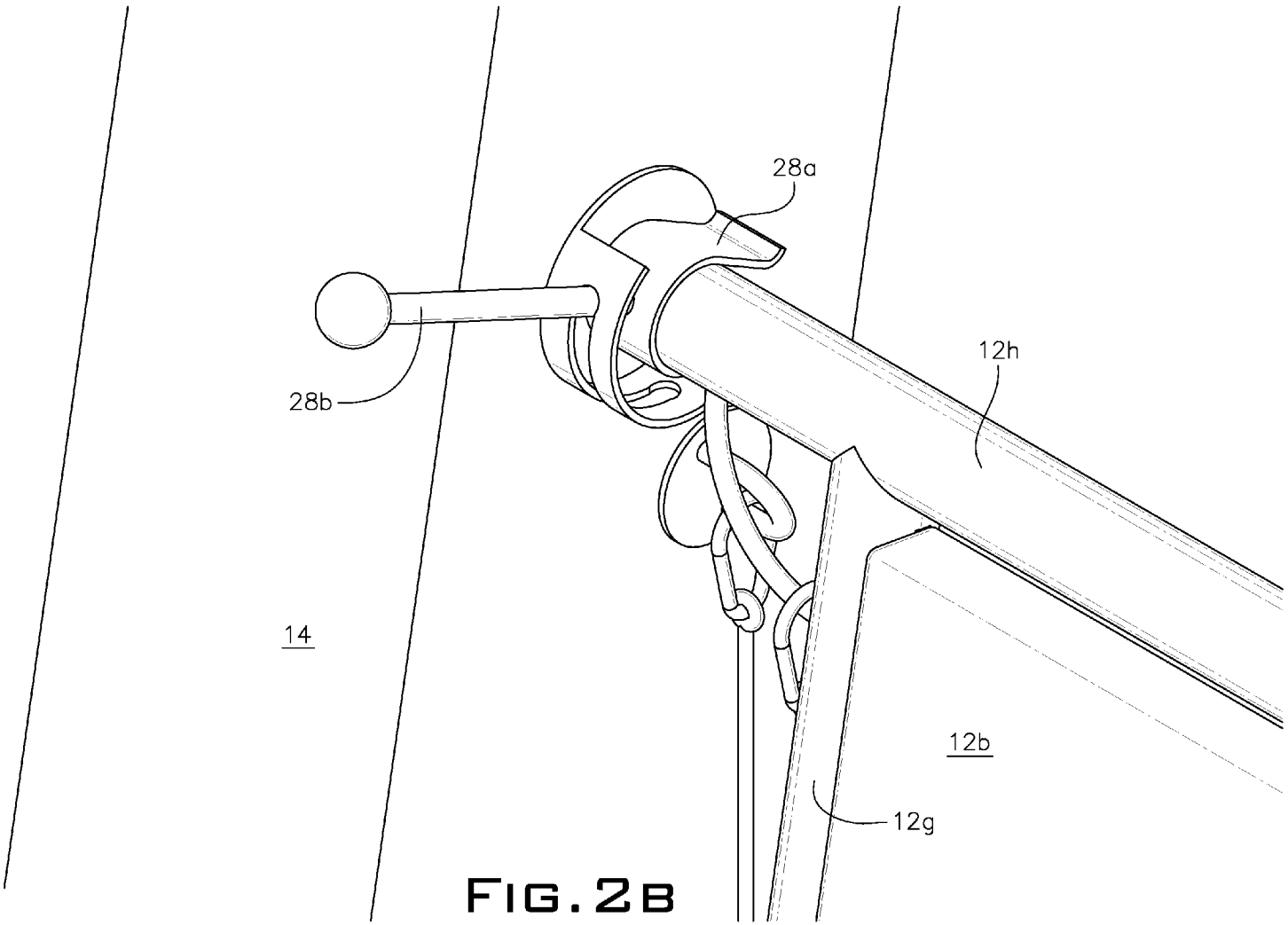
FIG. 2B is a perspective view of the example of FIG. 2A where the latching mechanism has engaged or is about to disengage the platform and the lever is pointing laterally to the davits in an unlocked position.
Figure 2C:
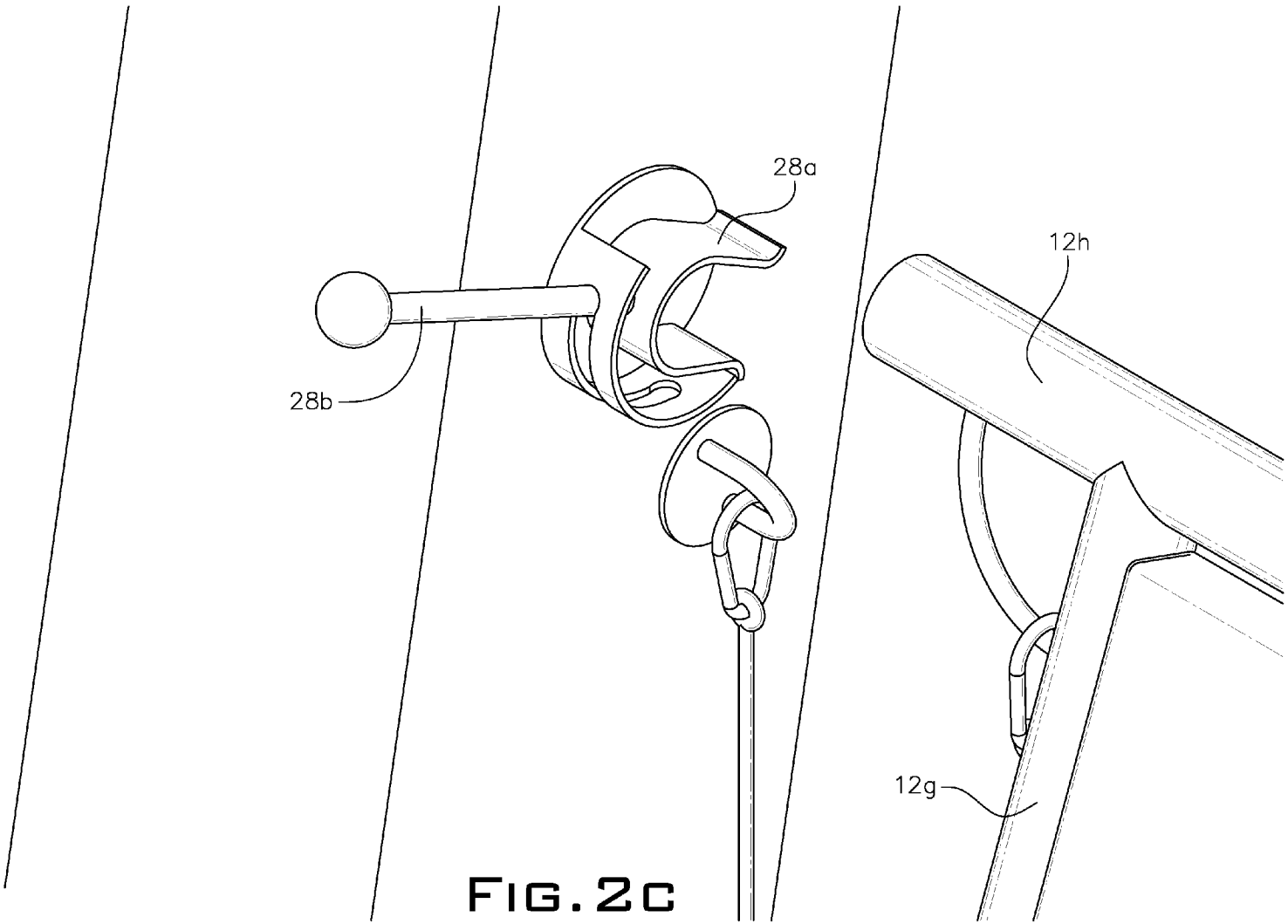
FIG. 2C is a perspective view of the example of FIG. 2A where the latching mechanism has disengaged or is in position to engage the platform and the lever is pointing laterally to the davits in an unlocked position.

The invention further includes means for selectively locking and unlocking an upper portion of the platform to each of the spaced-apart davits when the platform is in the upright position. As shown in FIGS. 2A-2C, one example of providing this feature is to have cross-frame members 12*h* near the upper edge of the platform 12 such as a tube running between the J-shaped frame members 12*g*. When in the upright position, the cross-frame member 12*h* can be snapped into two spaced-apart spring loaded C-clamp receivers 28*a*, which can be mechanized with an operatively connected lever 28*b* wherein each spring loaded C-clamp receiver 28*a* is configured to lock the cross-frame members 12*h* in place or to unlock and release the cross-frame member 12*h* when the platform 12 is to be lowered. Other means known in the art for locking and unlocking the platform in the upright position can be used (not shown), such as pins through the davits into a receiver aperture in the platform sides (or vice-versa); however, that described more specifically herein and in the drawings is merely an example of a preferred safety latching device.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A sea perch apparatus comprising:

a platform configured to be generally located between a pair of spaced-apart sea perch support members located on a boat, said sea perch support members comprising a superstructure portion extending above a hull portion of said boat and independent of said hull portion and located along one of a stern end, a starboard end, a port side, a bow end or combinations thereof of said boat; and said platform having means for selectively elevating said platform so as to be in a generally upright position between said sea perch support members and lowering said platform so as to be in a generally horizontal lower position at a predetermined height above a waterline in which said boat is floating when in the water, wherein when said platform is in the upright position, said platform serves as a guardrail between said sea perch support members, and wherein when said platform is in said lower position, said platform serves as a swimming dock or a tanning deck and further serves to facilitate easier embarking and disembarking to and from another boat.

2. The apparatus according to claim 1, wherein said platform further comprises:

means for transforming said platform into a seat when in said upright position.

3. The apparatus according to claim 2, wherein said seat comprises:

a bottom portion that is raised in a generally horizontal orientation to support one or more persons desiring to sit on said seat; and an upper portion which forms a back rest for said seat.

4. The apparatus according to claim 3, wherein said bottom portion further comprises an elevated arm rest on at least one side of said bottom portion.

5. The apparatus according to claim 3, further comprising means for maintaining said bottom portion in said generally horizontal position.

6. The apparatus according to claim 5, wherein said means for maintaining said bottom portion in said generally horizontal position comprises means for tying off a tie line near each front opposing corners of said bottom portion of said seat.

7. The apparatus according to claim 1, wherein said means for selectively elevating and lowering said platform comprises winch means for raising and lowering said platform from one of said sea perch support members.

8. The apparatus according to claim 1, further comprising means for selectively locking and unlocking an upper portion of said platform to each of said spaced-apart sea perch support members when said platform is in said upright position.

9. A sea perch apparatus comprising:

a platform configured to be generally located between a pair of spaced-apart sea perch support members located on a boat;

said platform having means for selectively elevating said platform so as to be in a generally upright position between said sea perch support members and lowering said platform so as to be in a generally horizontal lower position at a predetermined height about a waterline in which said boat is floating when in the water; and means for transforming said platform into a seat when in said upright position, wherein when said platform is in the upright position, said platform serves as a guardrail between said sea perch support members, and wherein when said platform is in said lower position, said platform serves as a swimming dock or a tanning deck and further serves to facilitate easier embarking and disembarking to and from another boat.

10. The apparatus according to claim 9, wherein said seat comprises:

a bottom portion that is raised in a generally horizontal orientation to support one or more persons desiring to sit on said seat; and an upper portion which forms a back rest for said seat.

11. The apparatus according to claim 10, wherein said bottom portion further comprises an elevated arm rest on at least one side of said bottom portion.

12. The apparatus according to claim 10, further comprising means for maintaining said bottom portion in said generally horizontal position.

13. The apparatus according to claim 12, wherein said means for maintaining said bottom portion in said generally horizontal position comprises means for tying off a tie line near each front opposing corners of said bottom portion of said seat.

14. The apparatus according to claim 9, wherein said means for selectivly elevating and lowering said platform comprises winch means for raising and lowering said platform from one of said sea perch support members.

15. The apparatus according to claim 9, further comprising means for selectively locking and unlocking an upper portion of said platform to each of said spaced-apart sea perch support members when said platform is in said upright position.

* * * * *